US007669304B2

(12) United States Patent
Louis Dit Picard et al.

(10) Patent No.: US 7,669,304 B2
(45) Date of Patent: Mar. 2, 2010

(54) METHOD AND DEVICE FOR HYDROENTANGLING A WEB MADE OF A FIBROUS CELLULOSE PRODUCT, AND A WEB OF THIS TYPE

(75) Inventors: Bernard Louis Dit Picard, Amfreville la Campagne (FR); Philippe Gregoire, Les Andelys (FR)

(73) Assignee: Georgia-Pacific France (FR)

( * ) Notice: Subject to any disclaimer, the term of this patent is extended or adjusted under 35 U.S.C. 154(b) by 0 days.

(21) Appl. No.: 12/327,049

(22) Filed: Dec. 3, 2008

(65) Prior Publication Data

US 2009/0113680 A1 May 7, 2009

Related U.S. Application Data

(63) Continuation of application No. 10/560,543, filed as application No. PCT/FR2004/001510 on Jun. 17, 2004, now Pat. No. 7,467,445.

(30) Foreign Application Priority Data

Jun. 18, 2003 (FR) ..... 03 07349

(51) Int. Cl.
*D04H 1/46* (2006.01)

(52) U.S. Cl. ..... 28/104

(58) Field of Classification Search ..... 28/104, 28/105, 106, 167, 163; 239/556, 560, 561, 239/558, 554, 601; 68/205 R, 200
See application file for complete search history.

(56) References Cited

U.S. PATENT DOCUMENTS

| | | | | |
|---|---|---|---|---|
| 1,958,038 | A | | 5/1934 | Fraser |
| 2,339,632 | A | | 1/1944 | Folsom |
| 2,591,621 | A | | 4/1952 | Shegda |
| 3,603,512 | A | | 9/1971 | Ham |
| 3,895,449 | A | * | 7/1975 | Chance et al. ..... 34/638 |
| 3,943,639 | A | | 3/1976 | Vits |
| 4,069,563 | A | | 1/1978 | Contractor et al. |
| 4,410,579 | A | | 10/1983 | Johns |

(Continued)

FOREIGN PATENT DOCUMENTS

EP 0148033 A2 7/1985

(Continued)

OTHER PUBLICATIONS

International Search Report for PCT/FR2004/001510, mail date Nov. 30, 2004.

(Continued)

*Primary Examiner*—Amy B Vanatta
(74) *Attorney, Agent, or Firm*—Joel T. Charlton

(57) ABSTRACT

The invention relates to a process of hydroentangling a fibrous web (N) including of positioning the web on a porous moving support (10) in translatory movement or in rotation about an axis, and of treating at least one side of the web by means of a plurality of streams of water arranged in a row perpendicular to the direction of movement of the web, characterized in that the row includes streams with a first cross-section (14A) and at least streams with a second cross-section (24A) different from the first. The invention also relates to a process including treatment of the web by means of a plurality of streams of water arranged in at least two rows perpendicular to the direction of movement of the web. The rows include streams with a first cross-section (14, 16, 17, 18, 19) and at least streams with a second cross-section (24, 26, 27, 28, 29, 39) different from the first cross-section, at least one row including streams the spacing of which is not constant. This process may be applied to produce webs the state of the surface of which varies.

13 Claims, 6 Drawing Sheets

U.S. PATENT DOCUMENTS

| | | | | |
|---|---|---|---|---|
| 4,691,417 | A | 9/1987 | Vuillaume | |
| 5,144,729 | A * | 9/1992 | Austin et al. | 28/105 |
| 5,428,876 | A * | 7/1995 | Boulanger et al. | 28/104 |
| 5,590,836 | A | 1/1997 | Thielbar | |
| 5,737,813 | A | 4/1998 | Sternlieb et al. | |
| 6,314,627 | B1 * | 11/2001 | Ngai | 28/104 |
| 6,571,441 | B1 * | 6/2003 | Kobayashi et al. | 28/104 |
| 6,887,486 | B2 | 5/2005 | Gregoire | |
| 6,998,360 | B1 | 2/2006 | Picard | |
| 7,426,776 | B2 * | 9/2008 | Love et al. | 28/167 |
| 2002/0078538 | A1 | 6/2002 | Ngai | |
| 2002/0092931 | A1 | 7/2002 | Coote | |
| 2003/0019088 | A1 | 1/2003 | Carter | |
| 2003/0101558 | A1 | 6/2003 | Sternlieb et al. | |
| 2003/0104036 | A1 | 6/2003 | Gregoire | |
| 2005/0071966 | A1 | 4/2005 | Barth et al. | |

FOREIGN PATENT DOCUMENTS

| | | | |
|---|---|---|---|
| EP | 0540041 | A1 | 5/1993 |
| EP | 1167605 | A1 | 1/2002 |
| EP | 1106723 | B1 | 3/2003 |
| EP | 1310226 | A2 | 5/2003 |
| JP | 2000-144564 | * | 5/2000 |
| WO | 94/11557 | A1 | 5/1994 |
| WO | 02/055778 | A1 | 7/2002 |

OTHER PUBLICATIONS

English translation of International Preliminary Report on Patentability, Chapter I, for PCT/FR2004/001510.

* cited by examiner

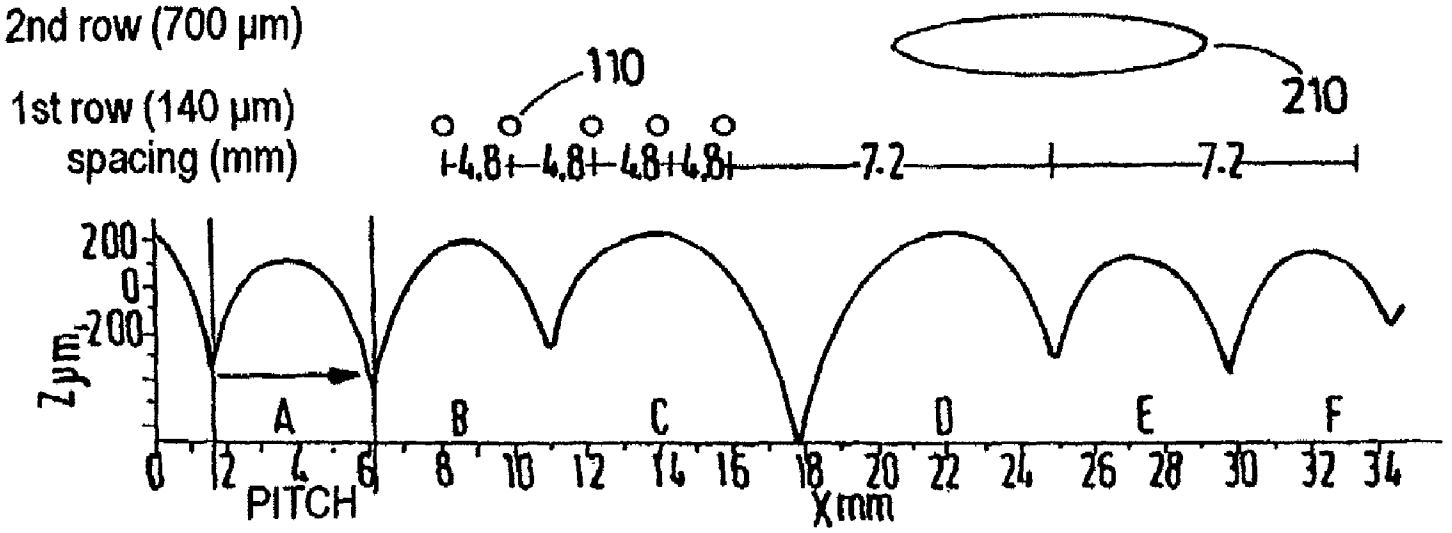
FIG.10
FIG.10A
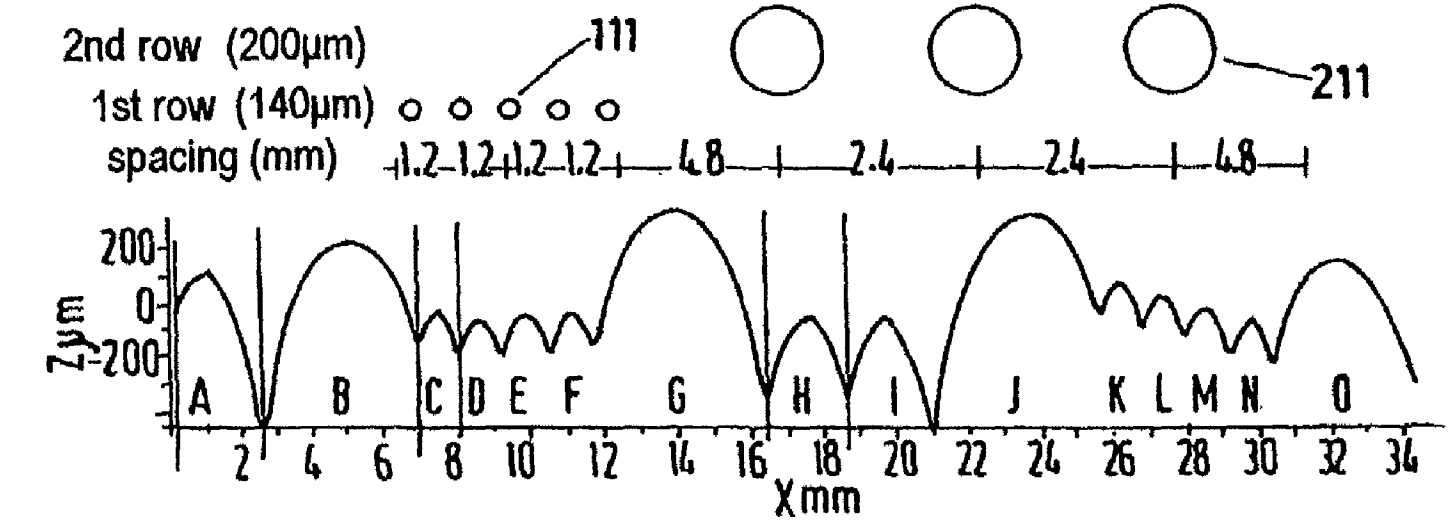
FIG.11
FIG.11A

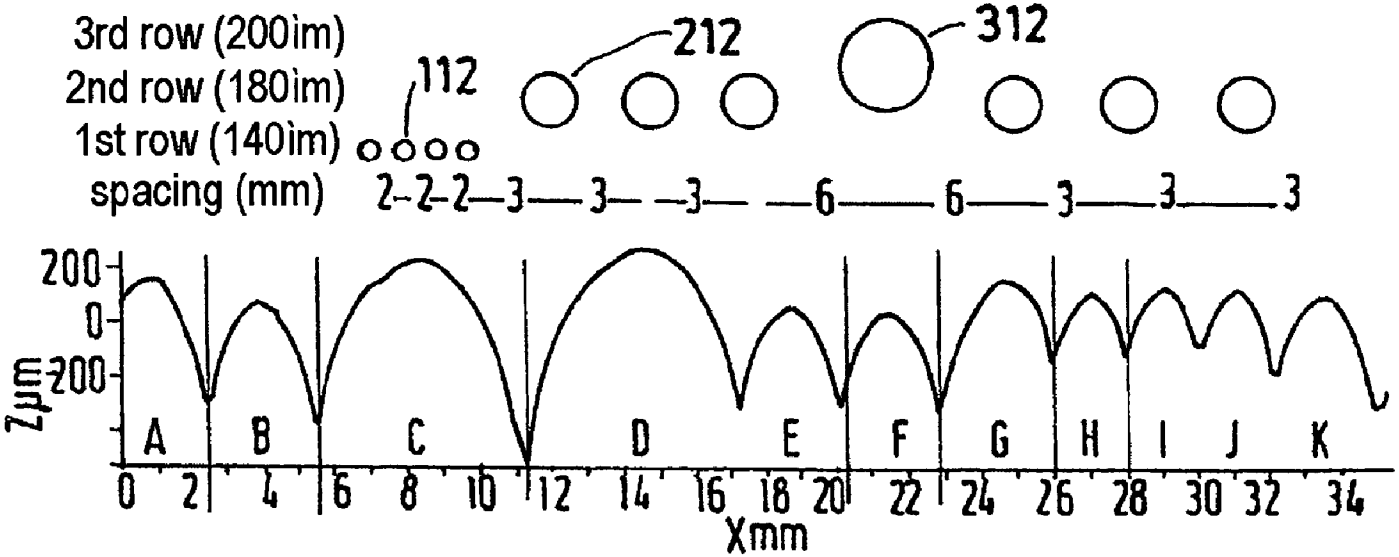
FIG.12
FIG.12A
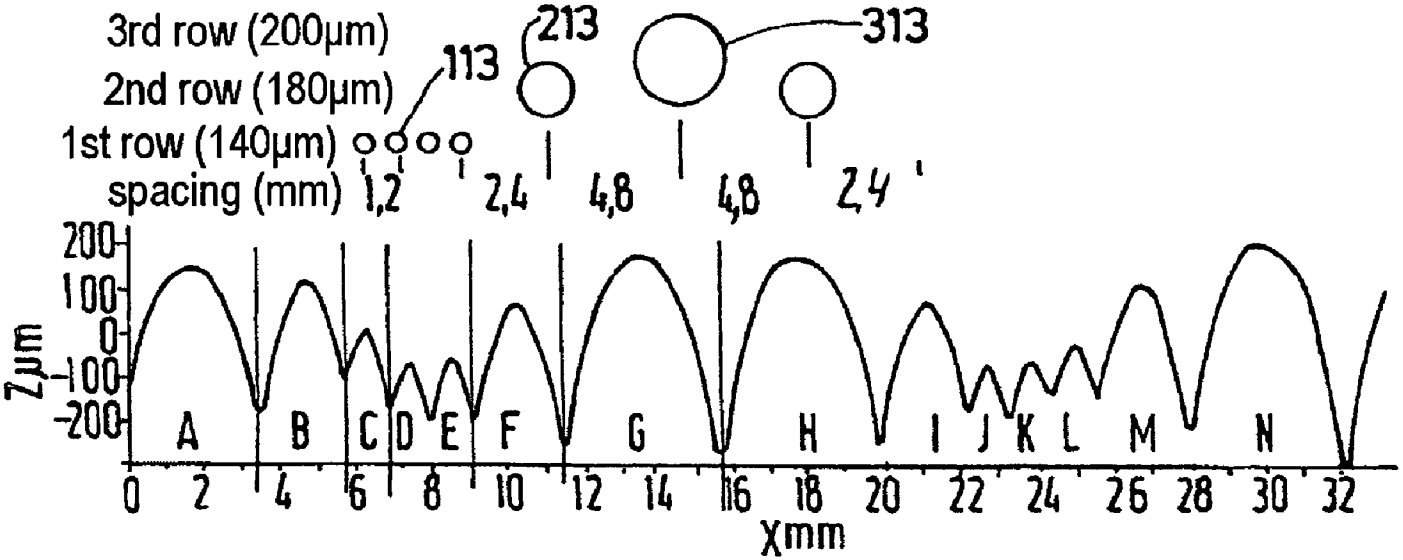
FIG.13
FIG.13A

METHOD AND DEVICE FOR HYDROENTANGLING A WEB MADE OF A FIBROUS CELLULOSE PRODUCT, AND A WEB OF THIS TYPE

This application is a continuation of prior U.S. patent application Ser. No. 10/560,543, filed Dec. 14, 2005, which was the National Stage entry of International Application No. PCT/FR2004/001510, filed Jun. 17, 2004, which claims priority to French Patent Application No. 03 07349, filed Jun. 18, 2003, the priorities of which are hereby claimed and their disclosures incorporated by reference in their entirety.

The present invention relates to the technique of water-jet entangling or hydroentangling a fibrous web, and in particular it relates to a means for obtaining a specified surface finish on a fibrous web consisting of cellulose fibers, especially hydrophilic cotton fibers, optionally blended with artificial or synthetic fibers. The present invention also relates to a hydroentangled web.

A known hydroentangling method consists in treating a fibrous web by means of high-pressure water jets for the purpose of entangling all or some of the fibers and of modifying some of its properties. The aim in particular of this method is to modify the mechanical strength and the linting thereof. The fibrous web is supported by a porous support wire which moves in a direction perpendicular to the alignments of the water jets. The latter are produced by an apparatus comprising one or more injectors placed across the direction of movement of the fibrous web. Usually, an injector comprises a high-pressure chamber in the form of a channel that communicates on one side with a plate provided with calibrated perforations, of circular shape, all with the same diameter and of suitable profile. The plate is denoted in the present field by the term "strip", and this term will be used hereafter. The delivery channel is fed by pumps delivering water at high pressure ranging from a few bar to 300 bar.

The perforations commonly have a diameter ranging from 80 μm to 200 μm and are uniformly spaced apart along the strip. The spacing ranges from 0.2 to 10 mm. Metal strips provided with one to three rows of perforations are available commercially. When there is more than one row, the perforations are arranged in a staggered configuration.

The porous support wire, on which the fibrous web lies, is driven along a flat table or else over a rotating cylinder. The support wire allows the water to pass through the fibrous web, and a suction means provided beneath the support wire ensures that the water is drained away.

Above a certain basis weight or thickness of the web, this device results in the production of an immediately visible relief formed from continuous lines, generally straight and mutually parallel lines uniformly spaced apart on the surface of the web. The lines are particularly clearly visible when the jets are spaced apart by at least one millimeter and are under a sufficient pressure. These lines are aligned in the run direction of the web.

These lines are in fact grooves made in the surface of the web, the depth, mutual spacing and width of which essentially depend on the arrangement of the water jets, on the pressure of the water fed into the injectors, on the diameter and the profile of the perforations, and on the speed at which the web runs relative to the jets.

For cosmetic usage—the application of makeup to the skin and/or its removal therefrom—the fibrous web preferably consists of cellulose fibers, and in particular hydrophilic cotton fibers, optionally blended with other, artificial or synthetic, fibers.

Patent EP 1 106 723 in the name of the Applicant discloses a pad cut from a hydrophilic cotton web having a basis weight of at least 150 g/m$^2$ and including recessed lines 1 to 8 mm apart and at least 0.25 mm in depth. This web furthermore has a certain tensile strength. The other face also includes recessed lines or stripes, but their spacing and their depth are different from those of the first face. This type of web is produced for example by hydroentangling. The web is driven beneath jets that have a suitable spacing and are of a suitable energy according to the relief that it is desired to obtain.

In an alternative form of the method, disclosed in patent application EP 010121057 (1 167 605), the water jets of the hydroentangling means form groups with jets spaced apart by a distance ranging from 0.4 to 1.2 mm, the groups of jets being spaced apart by a distance ranging from 1.2 to 4 mm. It is thus possible to produce webs having different reliefs on the two faces, while still avoiding the problem of linting for large spacings between the stripes. A cotton product is obtained which has its two faces differing from each other and which retains its mechanical resistance properties, namely lint resistance and in particular delamination resistance, and softness. One of the faces has a more scratchy effect than the other, for cleaning purposes.

The Applicant is permanently pursuing the objective of offering users improved products.

In particular, it had set itself, as primary objective, the development of hydroentangling means for producing products having a surface finish, in particular a relief, which is more elaborate than those known hitherto.

This is because the most widely used technique in the prior art aims to produce, on each face of a product, surfaces that are regularly striped or surfaces with a sequence of spacings between the stripes, the latter all being identical, even though one face can be distinguished from the other.

To meet the requirements of users in terms of applying or removing makeup, the Applicant had set itself as another objective the production of a product sufficiently thick and with a relief that would allow application to the skin of the necessary amount of makeup removal milk or lotion, but would also be able to enhance their makeup removal action by friction, but without irritating the skin. In particular, its aim is to produce a thick fibrous product that maintains bulk, has good strength both in the machine direction and in the cross direction, and has good absorption, while still being hydroentangled.

These objectives can be achieved with a method for the water-jet entangling of a fibrous web, consisting in placing the web on a porous support that can move translationally or rotationally about an axis and in treating at least one face of the web by means of a plurality of water jets arranged in a row perpendicular to the run direction of the web, characterized in that the row contains jets with a first cross section and at least jets with a second cross section different from the first.

These objectives can also be achieved with a method for the water-jet entangling of a fibrous web, consisting in placing the web on a porous support that can move translationally or rotationally about an axis and in treating the web by means of a plurality of water jets arranged in at least two rows perpendicular to the run direction of the web, characterized in that the rows contain jets with a first cross section and at least jets with a second cross section different from the first, at least one row containing jets whose mutual spacing is not constant.

Although the prior art teaches manufacturing methods for producing products that differ little from standard products, the Applicant has found, surprisingly, that it is possible to considerably increase the number of product grades by varying the cross section of the water jets along the row of perforations. In particular, the hydraulic diameter is not constant. The term "hydraulic diameter" is understood to mean the diameter of the circle having the same area as the cross section in question. For example, for an oval or polygonal cross section, the hydraulic diameter is the diameter of the circle that has the same area thereas.

Advantageously, the web is treated with jets arranged in at least two mutually parallel rows. Preferably, the number of rows is at most equal to four.

The method is particularly advantageous when the jets are produced by the same injector. Good synchronism is thus achieved between the spacings of the successive rows. The patterns on the web, and therefore on the end-products, are under tight control.

This arrangement allows a large number of combinations. According to one advantageous solution with at least two rows of jets, one row contains jets forming spaced-apart groups, the row that follows having jets that are not aligned, in the run direction of the web, with the jets of the first row.

According to another embodiment, one row contains jets forming spaced-apart groups, the row that follows having jets partly aligned, in the run direction of the web, with those of the first row.

Advantageously, the first row contains jets of a first cross section and the following row jets of a second cross section. Also advantageously, in another embodiment, the first row contains jets of a first cross section and jets of a second cross section, the following row containing jets of a second cross section or else jets of a second cross section and jets of a third cross section.

The method is applied to one face of the web. It may also be applied to both faces. The patterns on the two faces may be identical or different.

Advantageously, the fibers are essentially cellulose fibers, especially cotton fibers. For example, the web comprises 70 to 100% cotton fibers and 0 to 30% artificial or synthetic fibers. The web may have a weight of up to 400 g/m$^2$. Preferably, the basis weight is greater than 150 g/m$^2$. After the consolidating treatment, the web is converted into products in the form of round, oval, square or rectangular pads, or pads of any other form, for cosmetic or other use, as is known.

The invention also relates to a device for implementing the method, in which the jets are produced by perforations or orifices provided along a strip placed facing a water delivery channel. This device is characterized in that the perforations are placed along any one strip and have different cross sections.

Advantageously, the strip has at least two rows of perforations. In one embodiment, the perforations of any one row have the same cross section, this cross section being different from the perforations of the other row.

The invention also relates to a fibrous web comprising fibers hydroentangled by water jets, comprising, on at least one face, grooves formed by said hydroentangling. The web is characterized in that it comprises at least first grooves from 50 to 600 μm in depth with a spacing between a first groove and an adjacent groove ranging from 0.2 to 5 mm, and at least one second groove from 200 to 1000 μm in depth with a spacing between the second groove and an adjacent groove ranging from 2 to 9 mm, the depth and the spacing of the second groove both being greater than those of the first grooves.

The depth of the grooves is defined in a cross section taken perpendicular to their direction, on one face. A groove as two sidewalls, namely a right sidewall and a left sidewall. Each sidewall extends between the bottom of the groove and the first top encountered starting from the bottom. The depth of a groove is the difference in level between the top of one of the sidewalls and the bottom thereof.

In practice, for moderately deep or superficial grooves, the depth is defined as an average of two values measured on either side of the top between two adjacent grooves.

When the groove is deep, the two values on each side of the top are measured and the deeper of the two is used.

It should be noted that, whatever the depth of the groove, the measurement is made relative to its adjacent top—a remote top, even if it is at a higher level, is not taken into consideration.

The spacing is defined by the distance that separates the bottom of two adjacent grooves. This bottom is generally V-shaped.

The known patent application EP 1 310 226 relates to a pad of cotton wool for cosmetic use, the two faces of which have fine parallel grooves with a depth of 0.1 to 0.2 mm and a spacing of 0.5 to 0.7 m formed by water needling, and at least one face also has wide grooves with a depth of about 0.3 to 0.8 mm and a spacing of about 9.0 to 15.0 mm. It should be noted that this product is obtained by firstly passing the fibrous web beneath an injector that forms the fine grooves and beneath a second injector that forms the broad deep grooves. It follows that the broad grooves are formed by overimpression after a first consolidating operation by means of the fine-jet injectors.

The web of the invention differs from the subject matter of the above patent application by the fact that the shallower second grooves are visually distinguishable and spaced apart from the fine grooves. They form separate groups. By having unconsolidated regions, it is possible to combine the advantages of softness, absorption and thickness of an unconsolidated web with the mechanical strength and surface non-limiting of a hydroentangled web.

According to another feature, the web has groups of at least two adjacent second grooves and preferably at most six adjacent second grooves. Thus, regions in the form of bands are created with a visible relief having non-hydroentangled surfaces in which the fibers are not hydraulically linked together, conferring greater softness to the touch.

Preferably, the first grooves have a depth ranging from 50 to 250 μm. They form regions of greater bonding density than the previous ones.

Preferably, the spacing between a first groove and the adjacent groove closest to it ranges from 0.2 to 2 mm, and more particularly from 1 to 2 mm. Moreover, the spacing between a second groove and the adjacent groove closest to it preferably ranges from 3 to 5 mm.

According to another embodiment, the web includes third grooves different from the first and second grooves. For instance, the third grooves differ from the two others by their depth. In particular, the third grooves differ from the two others also by their spacing.

The invention will now be described in greater detail with reference to the appended drawings in which:

FIGS. 10 and 10A show, respectively, the pattern of perforations of an injector and the profile as measured carrying out hydroentangling trials;

FIGS. 11 and 11A show, respectively, a pattern of perforations of an injector and the profile as measured after carrying out second hydroentangling trials;

FIGS. 12 and 12A show, respectively, a pattern of perforations of an injector and the profile as measured after carrying out third hydroentangling trials;

FIGS. 13 and 13A show, respectively, a pattern of perforations of an injector and the profile as measured after carrying out fourth hydroentangling trails.

Figure 1:
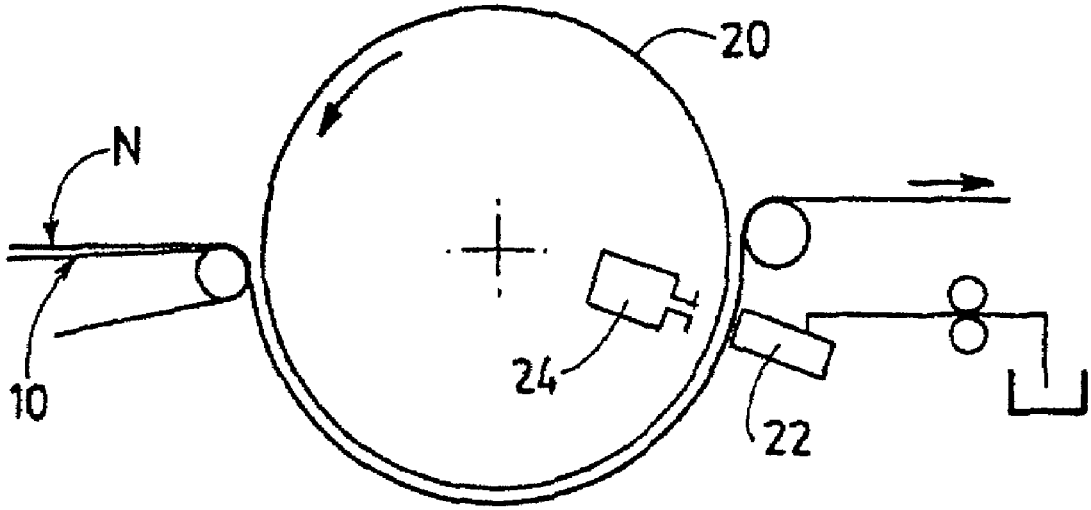
FIG. 1 shows schematically a conventional hydroentangling installation.

FIG. 1 shows schematically an installation for hydroentangling a fibrous web. The web N, the basis weight of which is preferably greater than 150 g/m$^2$, is supported on and driven by an endless belt 10. It is then transferred onto a perforated cylinder 20 that rotates about a horizontal axis. The web then passes in front of an injector 22 placed perpendicular to the run direction of the web. The perforations of the injector, which are distributed over the entire width of the web, are fed with pressurized water from a pump and deliver water jets onto the web N. On the opposite side of the web, inside the cylinder, there is a vacuum slot 24 for evacuating the water once it has passed through the web and through the porous support wire that forms the external surface of the cylinder. After treatment, the web is for example driven to a drying station. The figure shows only a single injector, but in other embodiments there are two or more injectors in parallel with the first, and preferably on each of the two faces of the web.

Figure 2:
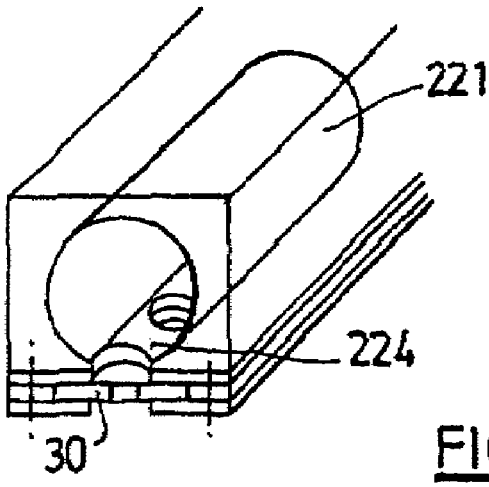
FIG. 2 shows schematically and in cross section an injector with a perforated strip.

The injector is shown in greater detail in FIG. 2. It comprises a manifold 221 in the form of a straight channel, here having a circular arcuate cross section. This channel includes a mesh 224 for distributing fluid along its axis. Mounted on this mesh is a strip 30 having the perforations. The strip is interchangeable and held in place by jaws along its axis. The pressurized water fills the delivery channel from a feed duct (not shown). The water is guided through the mesh 224 and then passes through the strip 30 in as may jets as there are openings made in the strip. These perforations or orifices have a profile, made in the thickness of the strip, which is designed to produce stable jets in the from of cylindrical needles. Such a profile may for example comprise, in succession, a cylindrical portion and a divergent portion. To the knowledge of the Applicant, the injection orifices of the prior art all have a circular cross section. Furthermore, their diameters are constant from one end of the strip to the other. Again according to the prior art, the strip may have up to three rows of injection orifices arranged in a staggered fashion. The purpose of a two-row or three-row arrangement is to give the web greater strength using one and the same injector.

Figure 3:
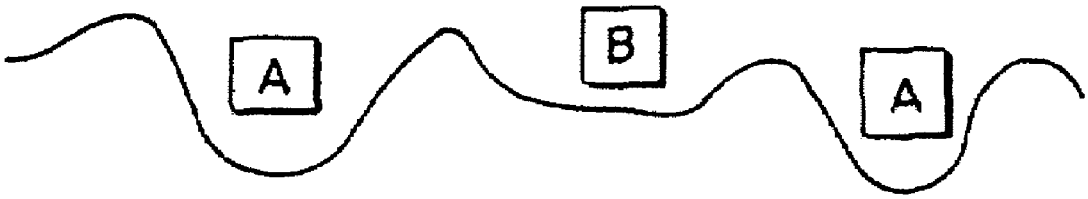
FIG. 3 shows schematically a sectional view of a treated web having a multi-level profile.

According to the invention, a complex relief structure is produced on the surface of the nonwoven resulting from the consolidation of the web. FIG. 3 shows an example of the profile of such a structure. Regions of different levels may be distinguished in the web N, namely a first region A, for example having a deeper first level, and a region B having a shallower level. In one application in which the web N is converted into a makeup-removal pad, the deeper regions A serve as reservoirs for makeup removal products or for beauty care milks to be applied to the skin. The shallower regions B are the active parts for the removal of makeup owing to the closer contact with the skin. They are reinforced by intermediate regions between the regions A and the regions B. Apart from having different levels, the regions A and B may have different widths.

The type of structure as shown in FIG. 3 is obtained by means of perforations made in the strip in accordance with the method of the invention. The perforations are likened to the jets produced.

Figure 4:
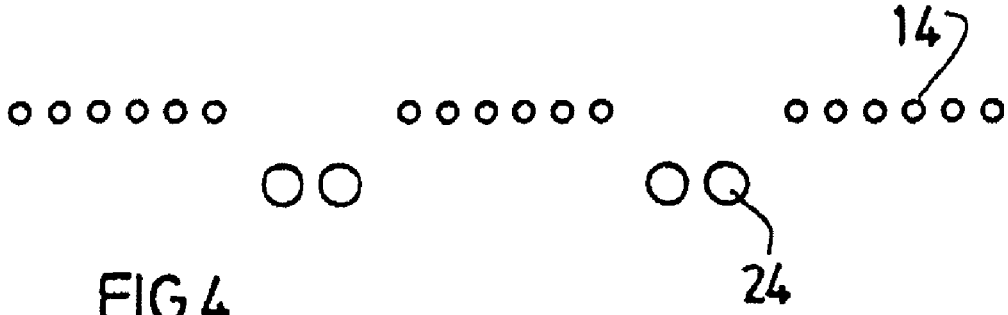
FIGS. 4 to 9 show schematically various arrangements of perforations in different rows.

FIG. 4 shows the arrangement of the perforations for obtaining a profile of the type shown in FIG. 3. This representation and the following ones have not been drawn to scale—the perforations diameters have been enlarged in order to make the invention more clearly understood. The perforations are arranged in two mutually parallel rows perpendicular to the run direction of the fibrous web. A first row is made up of circular perforations 14 having a first diameter. They are grouped together in fives with a first spacing between them. The perforations produce jets defined by their cross section.

Each group is spaced apart from its adjacent group by a distance greater than the first spacing. For example, the spacing between the perforations within a group may be 0.2 mm or more and the spacing between two adjacent groups may be greater than 2 mm, the diameter of the perforations being from 80 to 300 μm. In the next row there are perforations 24 whose diameter differs from that of the perforations 14. Here they are placed in the gap between two adjacent groups of the first row. Each group of the second row comprises two perforations placed so as to be inserted between the groups of the first row. Preferably, the two rows are placed on the same strip, as the perforations are then supplied under the same hydraulic, especially pressure, conditions. The jets emanating from the perforations of larger diameter are therefore of greater energy, since the energy is in this case proportional to the flow rate. The stripes or grooves formed by the latter perforations are deeper than the stripes formed by the first row. There is no interference between the jets emanating from the perforations of the two rows. The stripes are well separated. This is the best solution for correctly synchronizing the water jets and for controlling the final pattern.

Figure 4A:
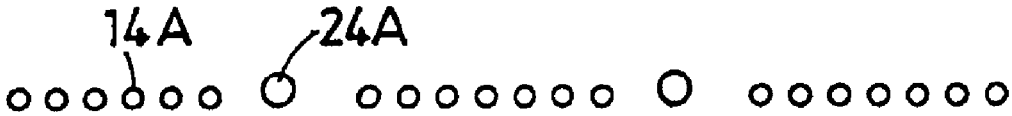

FIG. 4A shows an arrangement of perforations in a single row. It comprises perforations 14A with a first cross section and perforations 24A of a second cross section, different from the first.

Figure 5:
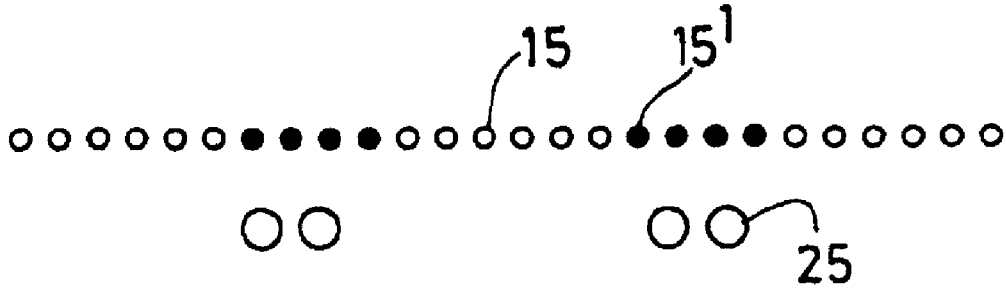

FIG. 5 shows another arrangement of perforations. It differs from the previous one by the addition of perforations 15' facing the perforations 25 of the following row. These perforations 15' differ from the perforations 15 by their longitudinal profile (not shown). They produce more diffuse jets and therefore less well pronounced grooves. The hydraulic characteristics of these perforations are for example degraded with respect to those of the perforations 15 in such a way that the jets produced mark the surface of the mark web very little the surface of the web very little. Their function is to prepare the web for receiving the jets emanating from the following row, which make more of a mark thereon.

Figure 6:
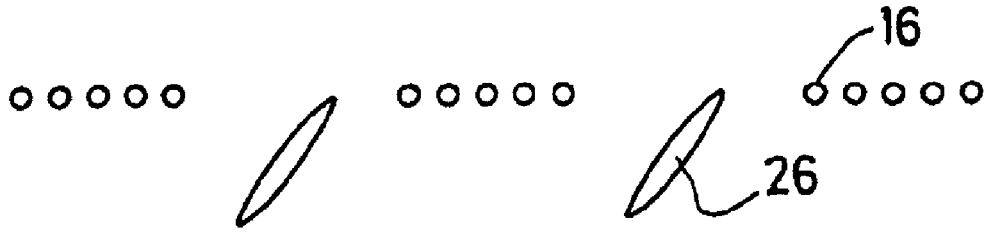

FIG. 6 shows perforations 26 in the second row that have a cross section of noncircular shape. The shape is oval, with its axis inclined to the alignment of the perforations 16. However, the shaped of the cross section may be different still and it is also possible to dispense with the inclination.

Figure 7:
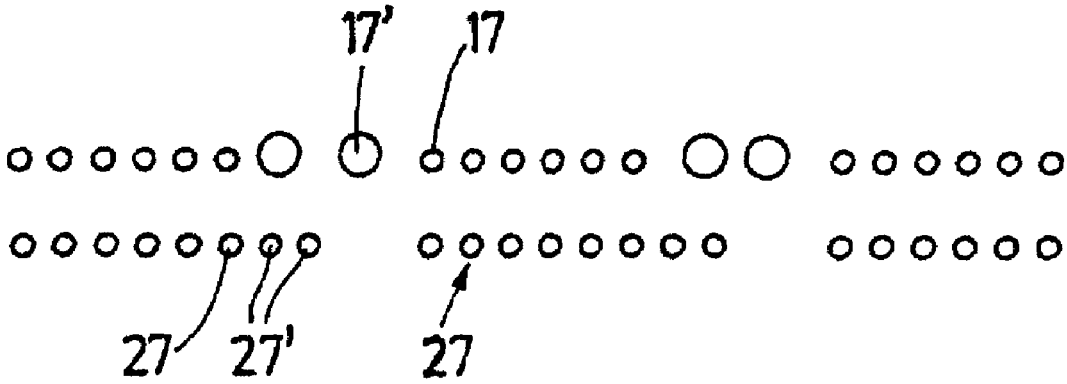

In FIG. 7, the perforations of the first row are of circular cross section. However, a distinction may be made between perforations 17 with a first cross section and perforations 17' with a second, larger-diameter, cross section. The perforations 17 are grouped together here in fives with a first spacing between them. The perforations 17', here two in number, are placed between these groups.

The second row contains perforations 27 with a cross section in this case identical to that of the first. They are aligned, in the run direction (which is perpendicular to the rows), with the perforations 17. Two perforations 27' are arranged in line with a perforation 17'. This arrangement produces stripes at various levels: a first level is obtained by the jets of the aligned perforations 17 and 27, a second level obtained by the alignment of the jets emanating from the perforations 17' and 27' and a third level is obtained by a perforation 17' alone.

Figure 8:
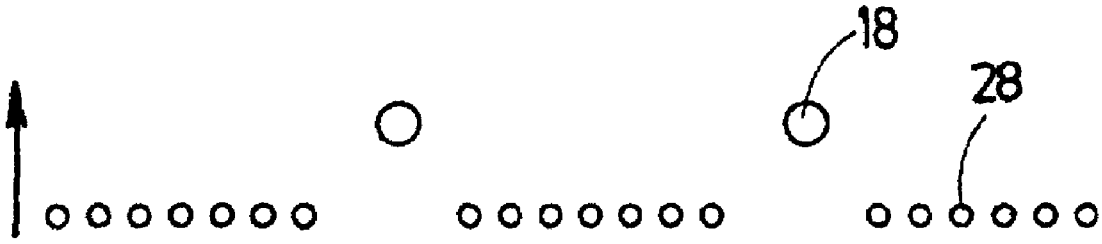

FIG. 8 shows two rows. The arrangement with respect to the run direction is inverted when compared with the arrangement shown in FIG. 4. The wider perforations are to the front.

Figure 9:
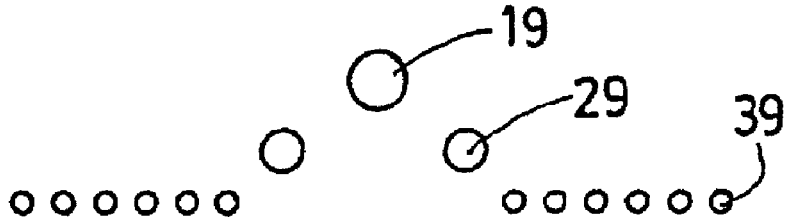

FIG. 9 shows an example of a strip with three rows 19, 29 and 39. The cross sections of the perforations 19 are the largest and the perforations 29 of the second row have a size intermediate between that of the perforations 19 and 39 of the third row. It may therefore be seen that the method makes it possible to produce striped webs of cotton or other cellulose fibers, in which the profile of the stripes may be varied.

Combinations other than those shown in here may be imagined without departing from the scope of the invention by varying both the arrangement of the perforations and their cross section.

Products according to the invention were produced with consolidating water injectors having, on one and the same strip, orifices arranged in different patterns.

FIG. 10 shows an injector whose strip has orifices distributed in two rows, namely the first row of orifices 110 of 140 μm diameter and a second row of orifices 210 of oval shape, the major diameter of which is 700 μm. The orifices are shown enlarged with respect their spacing. The repeat pattern here consists of five orifices 110 of 140 μm diameter with a mutual spacing of 4.8 mm, and of one oval orifice. The distance between the center of the oval orifice 210 and that of the adjacent orifice 110 is 7.2 mm. This pattern is repeated over the entire width of the injector. Four hydrophilic cotton webs of the same weight W were subjected to a hydroentangling treatment using such an injector, the water feed for which was set to a pressure P that differed in each case, namely 20, 40, 64 and 84 bar respectively. After treatment, the thickness of the web d in mm, its recovery or spring-back R in mm, the tensile strength in the machine direction $TS_m$ and the tensile strength in the cross direction $TS_c$ in newtons per inch of width (N/inch) were measured.

The thickness d of the web is the measurement of a stack of 20 formats cut from the web with a pressure of 2.25 g/cm$^2$ applied. The recovery R or thickness potential corresponds to the increase in the height of the stack of formats when the above pressure is removed.

The depth of the grooves was measured using the following method:

A specimen was placed beneath a CCD digital camera 3, taking care to ensure that the specimen was really flat and well centered. An image was taken. Suitable software, for example Optocat, was used for image acquisition and processing in the specified region of interest, by combining the Gray code technique with the phase shift technique. Automatic masking was used to remove spots having a poor contrast or having ambiguities. Next, software, for example Toposurf, was used to analyze the image obtained and to produce a profile of its relief. The relief on the curve obtained was measured.

For a given region examined, a curve such as that shown in FIG. 10A was obtained in which the distance in mm along the profile is plotted on the x-axis and the height in μm is plotted on the y-axis.

FIG. 10A shows that the measured region is divided here into segments A to F. Each of the segments comprises a bell-shaped profile with a peak between two grooves. The spacing between the grooves corresponds to that of the orifices made in the strip of the injector used, which can be readily checked. For each segment, the height of the peak relative to each of the two low points is determined. Two heights of the same peak, relative to the bottoms of the two lateral grooves respectively, are therefore obtained.

Next, for each of the peaks that does not correspond to a deep groove (here the grooves other than that between segments C and D), the average of the two values is determined. In the case of the deep grooves, the value used is the maximum value measured on their higher sidewall. In the present case there is only the one deep groove in the measured region, between C and D.

A value for each of the segments is obtained. Three values are used, namely the low value $D_s$, a high value $D_d$ and a moderate value $D_m$ respectively:

- the value $D_s$ corresponding to the depth of the superficial grooves that form said first grooves;
- the value $D_d$ corresponding to the maximum depth of the deep grooves that form said second grooves; and
- the value $D_m$ corresponding to the depth of the moderate grooves that form said third grooves or else said first grooves in the absence of a $D_s$ value.

In the present example, the $D_d$ and $D_m$ values could not be determined because of the nature of the pattern.

From the pressure P and the flow rate, the energy E (in $10^{-3}$ kWh/m$^2$) applied to the web can be determined.

A control web C was also produced, with an injector having only a single type of uniformly spaced orifice(s) according to prior art.

It is found that, for an applied energy value similar to that of the control (between 1 and $2\times10^{-3}$ kWh/m$^2$), large groove depths of between 600 and 850 μm are obtained for a pressure of between 40 and 64 bar only. This value should be compared with the 250 μm mean depth in the control web.

It is also observed that the thickness of the web is greater (63-66 mm as opposed to 58 mm) and the recovery is better (6 compared with 4).

The results are collected in the table below.

| Pattern 1 | | | | | | | | | | |
|---|---|---|---|---|---|---|---|---|---|---|
| Web | P (bar) | W (g/m$^2$) | d (mm) | R (mm) | $TS_m$ (N/inch) | $TS_c$ (N/inch) | $D_d$ (μm) | $D_m$ (μm) | $D_s$ (μm) | E |
| C | 34 | 257 | 58 | 4 | 24 | 17 | | 250 | | 1.72 |
| 1 | 84 | 245 | 63 | 6 | 23 | 15 | 898 | 464 | | 3.18 |
| 2 | 64 | 239 | 63 | 6 | 17 | 10 | 852 | 392 | | 2.12 |
| 3 | 40 | 240 | 66 | 6 | 12 | 7 | 614 | 299 | | 1.05 |
| 4 | 20 | 240 | 64 | 5 | 8 | 5 | 274 | 113 | | 0.37 |

In this example, the first grooves are the grooves defined by the segments A, B, C; D, E, F and the second groove is formed between segments C and D.

FIG. 11 shows another trial arrangement.

This pattern comprises, in a first row, a first group of five circular orifices 111 with diameters of 140 μm spaced apart by 1.2 mm and, in a second row, a second group of three circular orifices with diameters of 200 μm. The spacing between the orifices 211 is 2.4 mm. The second group is separated from the first group by a distance of 4.8 mm, on one side and on the other. This pattern is repeated over the entire length of the strip.

The profile, as measured using the method explained above, is shown in FIG. 11A.

The region examined reveals the presence of segments denoted by A to O, in which the following may be distinguished:

superficial first grooves of depth $D_s$, the value of which is determined from the sidewalls of the segments [C, D, E, F, K, L, M, N];

deep second grooves between segments A and B, G and H, and I and J [A, B, G, H; I, J]. The value $D_d$ of their depth is determined using the values measured on the right-hand sidewall of A, left-hand sidewall of B, right-hand sidewall of G and left-hand sidewall of J [A, B; G, J], respectively. The maximum value is used for $D_d$; and third grooves of depth $D_m$, the value of which is determined from the segments H and I [H, I].

The values determined are given in the table below.

It should be noted that this pattern produces deep second grooves, with a depth of up to 774 μm. This depth should be compared with the 4.8 mm spacing between the first group of orifices and the second group of orifices.

In a pattern variant, a pattern with a group of five first orifices 111 separated by a distance of 1 mm and a group of three second orifices separated by a distance of 4 mm may for example be envisaged.

FIG. 12 shows the pattern of injector orifices chosen for a third trial.

The injector comprises:

in a first row, a group of four circular orifices 112 with a 140 μm diameter and a 2 mm spacing;

in a second row, a group of three circular orifices 212 with a 180 μm diameter and a 3 mm spacing; and in a third row, a single circular orifice 312 with a 200 μm diameter and a 6 mm away.

FIG. 12A shows the profile of the relief, in a cross section transverse to the direction of the grooves, determined from the measurements carried out. Segments referenced A to K may be distinguished with:

superficial first grooves, defined by segments [G on the right, H, I, J];

a deep second groove, defined by the right-hand sidewall of C and the left-hand sidewall of D; and third grooves, of moderate or intermediate depth, defined by the sidewalls of segments E, F and the left-hand sidewall of G.

| Pattern 2 | | | | | | | | | | |
|---|---|---|---|---|---|---|---|---|---|---|
| Web | P (bar) | W (g/m$^2$) | d (mm) | R (mm) | $TS_m$ (N/inch) | $TS_c$ (N/inch) | $D_d$ (μm) | $D_m$ (μm) | $D_s$ (μm) | E |
| C | 34 | 257 | 58 | 4 | 24 | 17 | | 250 | | 1.72 |
| 1 | 84 | 236 | 52 | 4 | 48 | 27 | 774 | 338 | 157 | 6.55 |
| 2 | 64 | 233 | 56 | 4 | 35 | 18 | 620 | 261 | 111 | 4.35 |
| 3 | 40 | 239 | 62 | 6 | 18 | 11 | 428 | 209 | 83 | 2.15 |
| 4 | 20 | 228 | 63 | 6 | 8 | 5 | 271 | 142 | 54 | 0.76 |

The table below gives the values.

| Web | P (bar) | W (g/m$^2$) | d (mm) | R (mm) | $TS_m$ (N/inch) | $TS_c$ (N/inch) | $D_d$ | $D_m$ (μm) | $D_s$ | E |
|---|---|---|---|---|---|---|---|---|---|---|
| | | | | Pattern 3 | | | | | | |
| C | 34 | 257 | 58 | 4 | 24 | 17 | | 250 | | 1.72 |
| 1 | 84 | 230 | 50 | 3 | 49 | 35 | 774 | 370 | 233 | 4.3 |
| 2 | 64 | 222 | 57 | 4 | 28 | 18 | 704 | 373 | 221 | 2.86 |
| 3 | 40 | 237 | 60 | 5 | 15 | 11 | 592 | 302 | 168 | 1.41 |
| 4 | 20 | 228 | 63 | 5 | 8 | 5 | 308 | 113 | 61 | 0.50 |

FIG. 13 shows the injector pattern for a fourth trial:

The injector comprises:

in a first row, a group of four circular orifices 113 with a 140 μm diameter and a 1.2 mm spacing;

in a second row, a group of two circular orifices 213 with a 180 μm diameter and a 2.4 mm spacing; and in a third row, a single circular third orifice 313 with a 200 μm diameter and 4.8 mm away.

FIG. 13A shows the profile determined from the measurements made, in which the segments referenced A to N may be distinguished with:

superficial first grooves defined by segments [C, D, E, J, K, L];

three deep second grooves [left-hand sidewall of A; between G and H; and right-hand sidewall of N]; and moderate third grooves defined by segments [B, F, I, M].

The table below gives the measured values.

| Web | P (bar) | W (g/m$^2$) | d (mm) | R (mm) | $TS_m$ (N/inch) | $TS_c$ (N/inch) | $D_d$ | $D_m$ (μm) | $D_s$ | E |
|---|---|---|---|---|---|---|---|---|---|---|
| | | | | Pattern 4 | | | | | | |
| C | 34 | 257 | 58 | 4 | 24 | 17 | | 250 | | 1.72 |
| 1 | 84 | 237 | 47 | 3 | 46 | 34 | 501 | 244 | 105 | 6.31 |
| 2 | 64 | 227 | 56 | 4 | 34 | 22 | 536 | 133 | 114 | 4.19 |
| 3 | 40 | 226 | 59 | 5 | 19 | 12 | 464 | 232 | 111 | 2.07 |
| 4 | 20 | 229 | 62 | 5 | 8 | 5 | 221 | 139 | 55 | 0.73 |

The grooves are for example straight, but they could also be at least partly in broken, corrugated, sinusoidal form, in particular or even interrupted.

In a variant (not shown) of this pattern, a group of five or four orifices 113 (140 μm) 1.2 mm apart, a group of two orifices 213 (180 μm) with a spacing of 3.6 mm, and a third orifice 313 (200 μm) 3.6 mm away may also be imagined.

Figure 14:
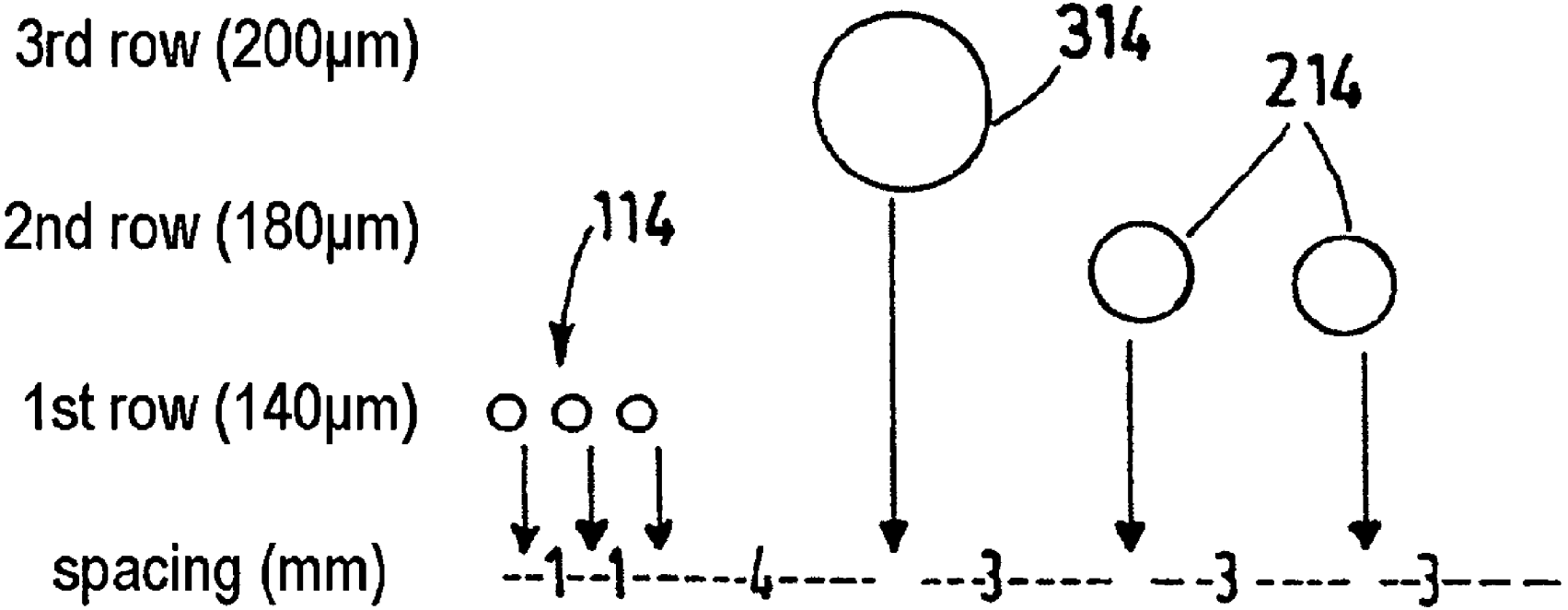
FIG. 14 shows an alternative arrangement of the orifices.

FIG. 14 shows another pattern variant with orifices distributed along any one injector strip.

The pattern comprises, in succession, in one row, a group of three orifices 114 (140 μm) 1 mm apart, in another row a group of two orifices 214 (180 μm) with a spacing of 3 mm and, in another row, again a single orifice 314 (200 μm) which is 3 mm away from the orifices 214 and 4 mm away from the orifices 114.

As may be seen, the arrangements of orifices with different diameters and different spacings in separate rows and in one and the same row may be varied.

What is claimed is:

1. A process of hydroentangling a fibrous web comprising:

positioning the fibrous web on a porous support in translatory movement or rotating about an axis;

treating the fibrous web by means of a plurality of streams of water arranged in at least two rows perpendicular to a direction of movement of the fibrous web, the streams having a cylindrical form, wherein the at least two rows comprise streams of a first constant cross-section and streams of a second constant cross-section different from the first cross-section, and at least one row of said at least two rows comprises streams of non-constant spacing; and forming a relief structure in the fibrous web, wherein the streams of the first constant cross-section and the streams of the second constant cross-section hydroentangle the fibrous web creating at least a first region having a first level and a second region having a second level, the first level being distinct from the second level.

2. A process as defined in claim 1, wherein said treating is with streams arranged in from two to four rows.

3. A process as defined in claim 1, wherein the rows of streams are produced by a common injector.

4. A process as defined in claim 2, wherein the rows of streams are produced by a common injector.

5. A process as defined in claim 2, wherein a first row comprises streams made up of groups spaced at intervals from each other, and a second row comprises streams not in alignment in the direction of movement of the web with the streams of the first row.

6. A process as defined in claim 2, wherein a first row comprises streams made up of groups spaced at intervals from each other, and a second row comprising streams aligned in part in the direction of movement of the fibrous web with the streams of the first row.

7. A process as defined in claim 5, wherein the first row comprises streams of a first cross-section and the second row comprises streams of a second cross-section.

8. A process as defined in claim 6, wherein the first row comprises streams of a first cross-section and the second row comprises streams of a second cross-section.

9. A process as defined in claim 1, wherein the fibrous web comprises cellulose fibers.

10. A device for hydroentangling a fibrous web comprising:

an endless belt;

an injector including a plurality of perforations arranged in at least two rows perpendicular to a direction of movement of the endless belt, the perforations having a first constant cross-section and a second constant cross-section different from the first constant cross-section, the injector being configured and disposed to direct a plurality of streams of water toward the endless belt, the plurality of streams of water being adapted to hydroentangle and form a relief structure in a fibrous web creating at least a first region having a first level and a second region having a second level, the first level being distinct from the second level.

11. A device as defined in claim 10, wherein the strip has at least two substantially parallel rows of perforations.

12. A device as defined in claim 11, wherein at least one of the at least two substantially parallel rows includes perforations of non-constant spacing.

13. The device as defined in claim 10, wherein the diameter of the cross-sections range from approximately 80 μm to approximately 200 μm.

* * * * *